US011794060B2

(12) United States Patent
Haynes

(10) Patent No.: US 11,794,060 B2
(45) Date of Patent: Oct. 24, 2023

(54) CORE SWINGING APPARATUS AND METHOD

(71) Applicant: Zachary Haynes, Houston, TX (US)

(72) Inventor: Zachary Haynes, Houston, TX (US)

( * ) Notice: Subject to any disclaimer, the term of this patent is extended or adjusted under 35 U.S.C. 154(b) by 199 days.

(21) Appl. No.: 17/497,967

(22) Filed: Oct. 10, 2021

(65) Prior Publication Data

US 2022/0118303 A1 Apr. 21, 2022

Related U.S. Application Data

(60) Provisional application No. 63/093,136, filed on Oct. 16, 2020.

(51) Int. Cl.
*A63B 21/06* (2006.01)
*A63B 23/02* (2006.01)
*A63B 21/00* (2006.01)

(52) U.S. Cl.
CPC ..... *A63B 21/0615* (2013.01); *A63B 21/4035* (2015.10); *A63B 23/0211* (2013.01)

(58) Field of Classification Search
CPC ... A63B 15/00; A63B 15/005; A63B 21/0004; A63B 21/00058; A63B 21/00061; A63B 21/00065; A63B 21/00069; A63B 21/00072; A63B 21/028; A63B 21/05; A63B 21/0601; A63B 21/0602; A63B 21/0603; A63B 21/0604; A63B 21/0615; A63B 21/15; A63B 21/159; A63B 21/4033; A63B 21/4035; A63B 21/4047; A63B 21/4049; A63B 23/02; A63B 23/0211; A63B 23/035; A63B 23/03516; A63B 71/0054; A63B 2071/0063; A63B 2071/0072
See application file for complete search history.

(56) References Cited

U.S. PATENT DOCUMENTS 3,475,024 A * 10/1969 Lewis ..... A63B 21/0615 482/97
4,805,900 A * 2/1989 Sapp ..... A63B 21/00069 482/121
5,209,481 A * 5/1993 DeBack ..... A63B 21/4047 473/220
5,431,616 A * 7/1995 Centofante ..... A63B 23/129 482/905
D575,369 S * 8/2008 Eno ..... D21/791
7,476,183 B1 * 1/2009 Chrest ..... A63B 23/12 482/93
9,028,378 B2 * 5/2015 Shah ..... G05G 1/10 482/109
9,289,646 B2 * 3/2016 Tully ..... A63B 23/03525
9,808,663 B2 * 11/2017 Chen ..... A63B 21/4049
9,821,186 B2 * 11/2017 Chen ..... A63B 23/1209

(Continued)

*Primary Examiner* — Gary D Urbiel Goldner
(74) *Attorney, Agent, or Firm* — Darryl Edwin Scott

(57) ABSTRACT

A core exercise apparatus having a frame. The frame has a first wall, a second wall, a frame roof, and a frame floor. A first bumper is coupled to the frame roof. A second bumper is coupled to the frame roof. A first plate is coupled to the first frame wall. A second plate is coupled to the second frame wall. An elongated handle is coupled to the frame floor. A pendulum is coupled to the first plate and second plate such that the pendulum swings from the first bumper to the second bumper and from the second bumper to the first bumper.

20 Claims, 5 Drawing Sheets

(56) References Cited

U.S. PATENT DOCUMENTS

| | | | | |
|---|---|---|---|---|
| 10,029,134 | B2 * | 7/2018 | Gavigan | A63B 43/02 |
| 10,265,568 | B2 * | 4/2019 | Silagy | A63B 23/14 |
| 10,792,534 | B2 * | 10/2020 | Klecka | A63B 21/0724 |
| 10,799,753 | B2 * | 10/2020 | Koenig | A63B 21/072 |
| D931,957 | S * | 9/2021 | Rodriguez | A63B 21/0615<br>D21/673 |
| 2004/0023763 | A1 * | 2/2004 | Sleiman | A63B 21/4047<br>482/121 |
| 2008/0207289 | A1 * | 8/2008 | Kang | A63B 21/4047<br>463/7 |
| 2012/0149539 | A1 * | 6/2012 | Quader | A63B 21/0728<br>482/109 |
| 2013/0190145 | A1 * | 7/2013 | Kugielsky | A63B 21/00058<br>482/110 |
| 2014/0051554 | A1 * | 2/2014 | Walker | A63B 21/0728<br>482/109 |
| 2016/0151657 | A1 * | 6/2016 | Kugielsky | A63B 21/0004<br>482/93 |
| 2017/0266479 | A1 * | 9/2017 | McCall | A63B 15/00 |
| 2019/0366143 | A1 * | 12/2019 | McCall | A63B 21/4035 |
| 2020/0376314 | A1 * | 12/2020 | Spillman | A63B 21/4035 |

* cited by examiner

CORE SWINGING APPARATUS AND METHOD

CROSS-REFERENCE TO RELATED APPLICATIONS

This application claims the benefit of U.S. Provisional Application No. 63/093,136 filed Oct. 16, 2020.

BACKGROUND

There are different types of training equipment used in fitness and sports. For example, in CrossFit or other similar methods of training, general exercise equipment may include heavy kettle bells, tractor tires, sledgehammers, weighted sleds, and sandbags. These items may be too bulky or impractical for use in personal home gyms. In addition, many of these items may cause serious injury to athletes and fitness enthusiast if they are not monitored by a professional. One popular CrossFit exercise is the sledgehammer exercise. This exercise stimulates and trains the athlete's core muscles by swinging a ten to twenty-pound sledgehammer onto a tractor tire weighing five-hundred-pounds or more. The benefit of a sledgehammer exercise is how effectively it develops strength and power and engages multiple muscle groups and joint movements, thus increasing explosive power and agility. However, participating in this exercise has many risks and is impractical for personal home use. Acquiring and storing tractor tires and managing a twenty-pound sledgehammer may be too burdensome and difficult for some enthusiast. Simulating the sledgehammer workout for personal use in a restricted environment is a challenge.

DETAILED DESCRIPTION

Figure 1:
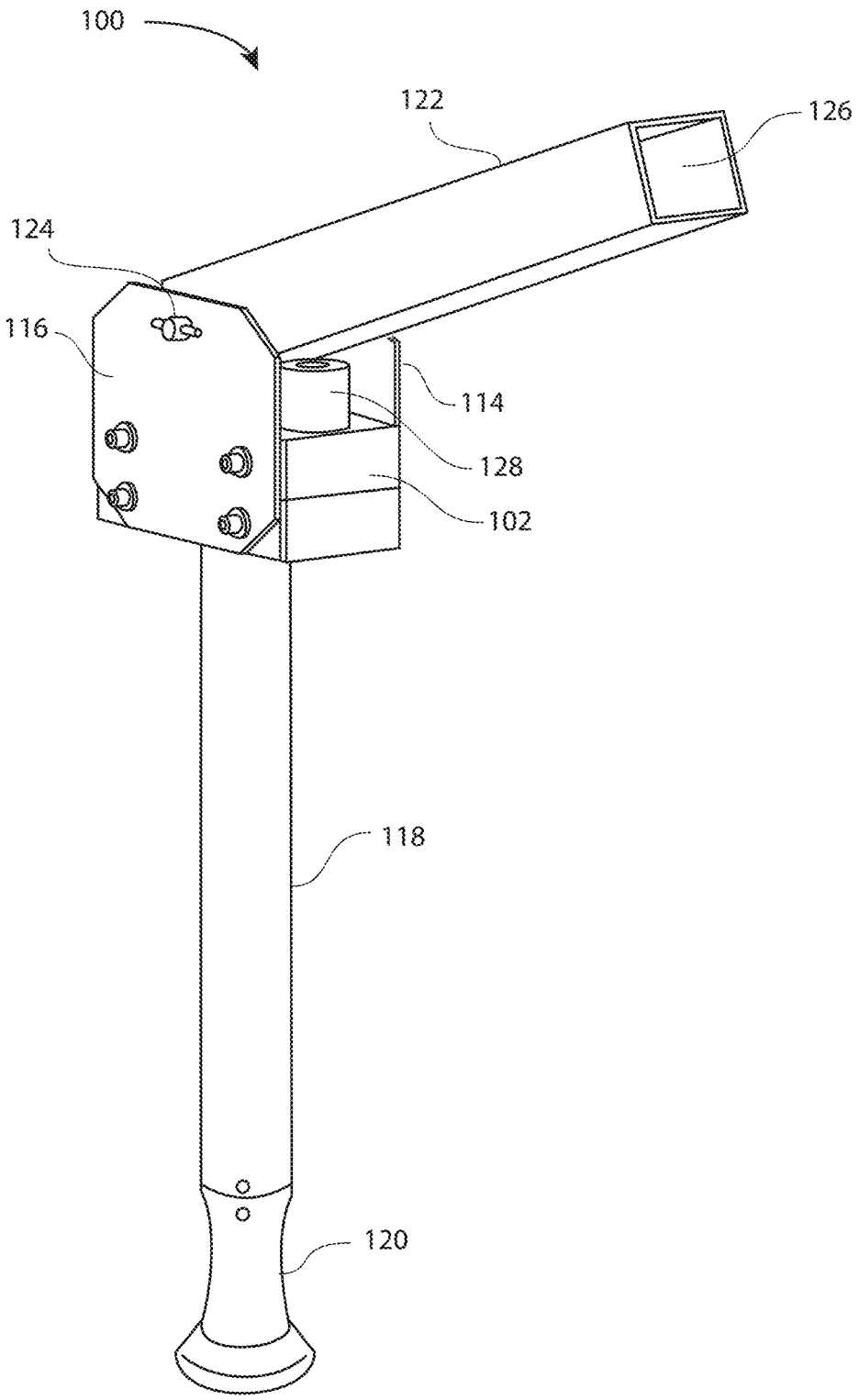
FIG. 1 is a perspective view of a core exercise apparatus.

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

There are many different types of training equipment used in fitness and sports. For example, in CrossFit or other similar methods of training, general exercise equipment may include heavy kettle bells, tractor tires, sledgehammers, weighted sleds, sandbags, and metal chains. These items may be too bulky or impractical for use in personal home gyms. For example, tractor tires and weighted sleds cannot be used or stored in most conventional homes. In addition, many of these items may cause serious injuries to athletes and fitness enthusiast if the equipment is not properly secured. Mitigating injury (i.e., spotting) is also challenged if the athlete is not monitored by a third-party member (i.e., exercise partner).

One popular CrossFit routine is the sledgehammer exercise. This exercise stimulates and trains the athlete's core muscles by swinging a ten to twenty-pound sledgehammer onto a tractor tire weighing five-hundred-pound or more. The benefit of a sledgehammer exercise is its effectiveness in how it develops strength and power and engages multiple muscle groups and joint movements, thus increasing explosive power and agility. By swinging the sledgehammer onto a tractor tire, the athlete engages both its primary muscle and secondary muscles (i.e., stabilizing muscles). For example, when the athlete lifts and swings the sledgehammer onto the tractor tire the athlete's primary muscles are engaged. The responding counter force created by the tractor tire onto the sledgehammer forces the athlete to engage its secondary muscles (i.e., stabilizing the sledgehammer). This method of engaging the primary muscles and secondary muscles in one exercise routine is highly effective at burning calories and building strength.

However, participating in this exercise has many risks and is impractical for personal home use. Further, procuring and storing tractor tires and managing a twenty-pound sledgehammer may be too expensive and burdensome for home-enthusiast. The embodiments described herein provides an apparatus that allows fitness enthusiast and athletes to simulate the sledgehammer exercise without the need for a conventional sledgehammer and tractor tire. Specifically, the embodiments describe a core exercise apparatus.

Figure 2:
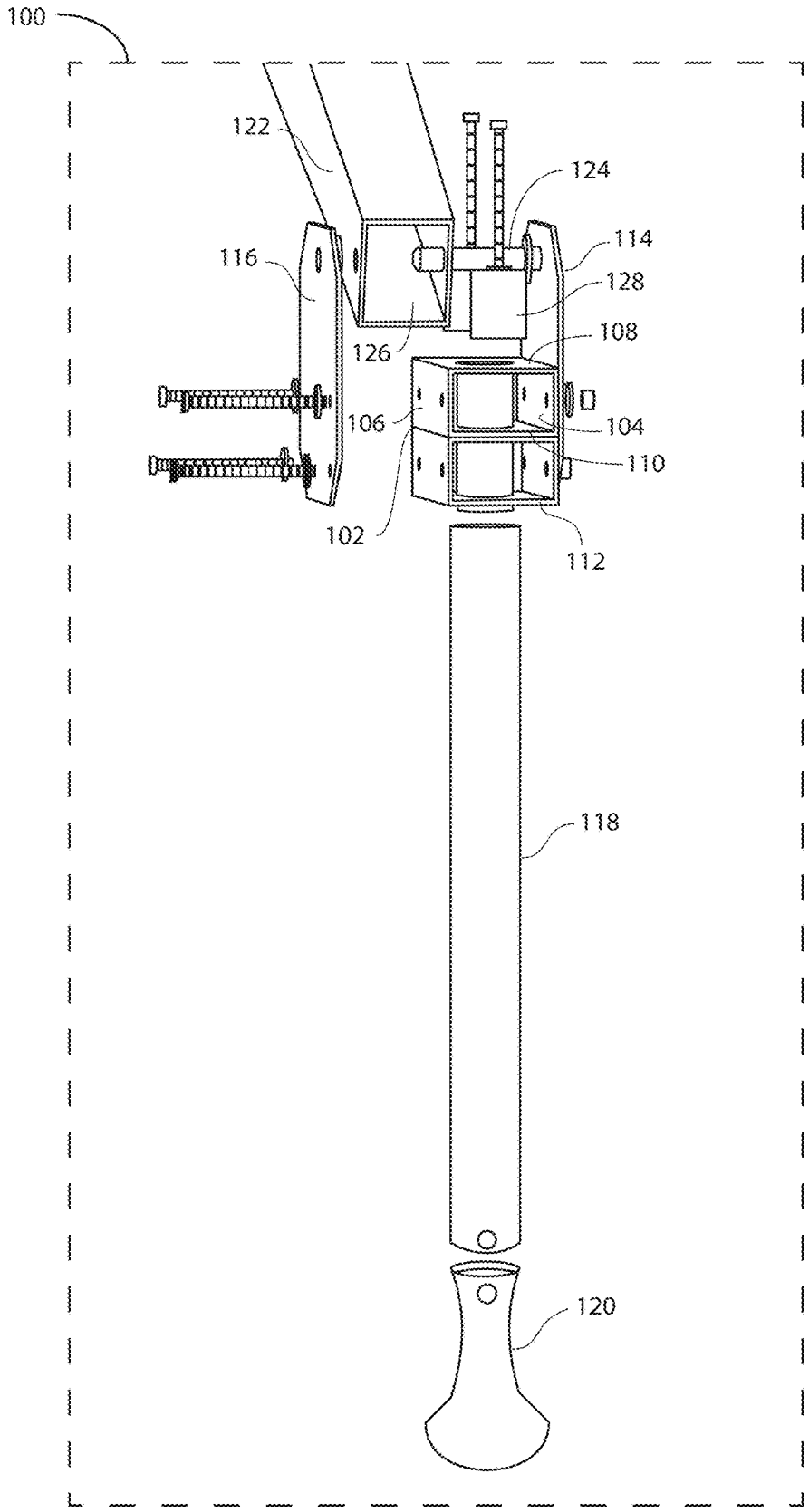
FIG. 2 is an exploded perspective view of a core exercise apparatus.
Figure 3:
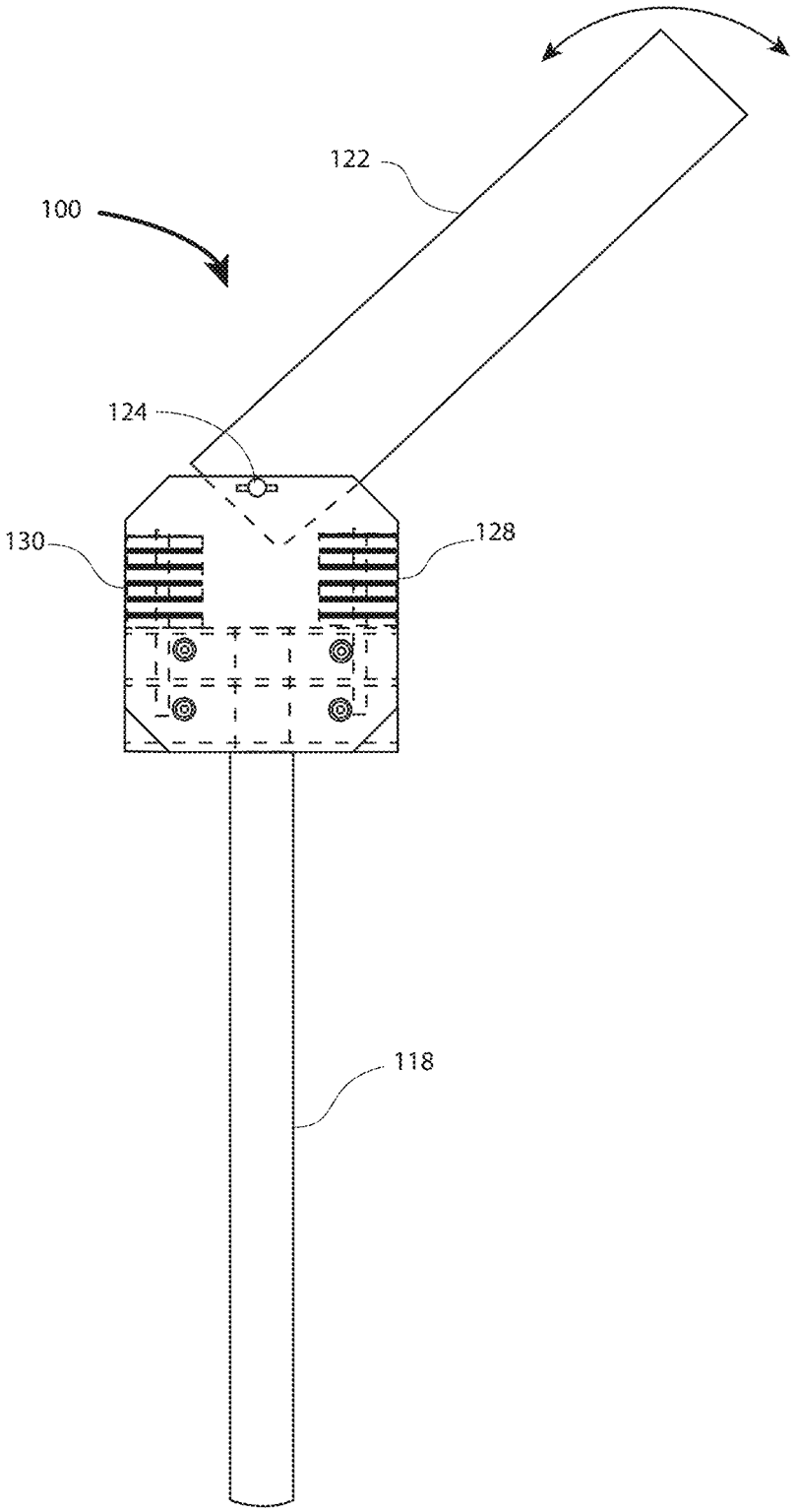
FIG. 3 is a transparent profile view of a core exercise apparatus.

FIG. 1 is a perspective view of a core exercise apparatus. FIG. 2 is an exploded perspective view of a core exercise apparatus. FIG. 3 is a transparent profile view of a core exercise apparatus. As illustrated in FIGS. 1, 2, and 3 a core exercise apparatus 100 resembles a conventional sledgehammer, in that it has an elongated handle coupled to a weighted end (e.g., the hammer portion of a sledgehammer).

As illustrated in FIG. 1, the core exercise apparatus 100 may include a frame 102. The frame 102 is the component of the core exercise apparatus 100 that provides structural support and is the primary element that other mechanisms of the core exercise apparatus 100 are coupled to. When decoupled, the frame 102 would have similar characteristics of the hammer portion of a sledgehammer. The frame 102 may be comprised of metal or other similar material, such as steel, carbon steel, alloy steel, or iron (wrought or cast) for example.

In one or more embodiments, as illustrated in FIG. 2, the frame 102 includes a first frame wall 104 and a second frame wall 106 positioned opposite the first frame wall 104. That is, the first frame wall 104 and second frame wall 106 are positioned parallel to one another and are separated by and coupled to a frame roof 108 and frame floor 110.

Although FIG. 2 illustrates the frame 102 having a cavity (i.e., forming a hollow cube), the frame may form a solid piece not having a cavity or may be sealed by two end caps as illustrated in FIG. 1. Varying between having a frame 102 that is hollow and a frame 102 that is solid (not illustrated) allows for structural advantages as well as weight options. In one or more embodiments, as illustrated in FIGS. 1 and 2, the frame 102 may include a second frame 112 coupled to the first frame 102. The second frame provides additional support and structural integrity to the core exercising apparatus 100. In one or more embodiments, the second frame 112 includes all the same embodiments as the initial frame 102. In that, the second frame 112 has a first frame wall, a second frame wall, a frame roof, a frame floor, and is comprised of metal or other similar material.

As in FIGS. 1 and 2, the core exercise apparatus 100 may include a first plate 114. In one or more embodiments, the first plate 114 is coupled to the first frame wall 104. In one or more embodiments, the core exercise apparatus 100 includes a second plate 116. The second plate 116 may be coupled to the second frame wall 106. In one or more embodiments, the first plate 114 and second plate 116 may be comprised of metal or other similar material.

As illustrated in FIGS. 1, 2, and 3, the core exercise apparatus 100 may include an elongated handle 118. The elongated handle 118 may be coupled to the frame floor 110. In variations where the core exercising apparatus 100 has two frames (i.e., frame 102 and second frame 112) the elongated handle 118 may be coupled to either the frame floor 110 of the frame 102 or coupled to the frame floor of the second frame 112. The elongated handle 118 may be coupled to the frame floor 110 by welding or by an external threaded end (not shown) that screws into an internal thread bored into a solid frame. The elongated handle 118 may vary in length between one foot six inches (i.e., 45.7 centimeters) to four feet (i.e., 121.92 centimeters). In one or more embodiments the elongated handle 118 may be manufactured from wood, plastic, metal, or other similar material. The elongated handle 118 may be interchangeable. In one or more embodiments, an individual has the option of changing the elongated handle 118 to a size suitable for their parameters.

As illustrated in FIGS. 1 and 2, the elongated handle 118 may include an interchangeable grip 120. The interchangeable grip 120 is the section of the core exercise apparatus 100 that is gripped by an individual to perform the exercise. The interchangeable grip 120 may be comprised of metal or other similar material and enveloped by rubber or other similar material. The interchangeable grip 120 may be manufactured in different grip styles to compliment an individual's parameters.

As illustrated in FIGS. 1, 2, and 3, the core exercise apparatus 100 may include a pendulum 122. The pendulum 122 may be coupled to and between the first plate 114 and second plate 116. The pendulum 122 is coupled to the first plate 114 and second plate 116 by a rivet 124 such that the pendulum 122 is free to rotate about the rivet 124. In one or more embodiments, the pendulum 122 is interchangeable and can be replaced with a larger or smaller (i.e., in weight and size) pendulum 122. The pendulum 122 may form an elongated cube. In other embodiments, the pendulum 122 forms a variety of shapes (e.g., tear drop shape, cylinder shape, triangle shape) such that the pendulum 122 is couplable to the rivet 124 and functionally capable of swinging back and forth about the rivet 124. In one or more embodiments, as illustrated in FIGS. 1 and 2, the pendulum 122 includes a cavity 126 such that weighted material (not illustrated) can be inserted into the cavity 126 and coupled to the pendulum 122. The pendulum 122 may comprised of metal or other similar material.

As partially illustrated in FIGS. 1 and 2, and fully illustrated in FIG. 3, the core exercise apparatus 100 may include a first bumper 128 coupled to the frame roof 108 and a second bumper 130 coupled to the frame roof 108. The bumpers (i.e., first bumper 128 and second bumper 130) are the components of the core exercise apparatus 100 that receives and absorbs the impact of the pendulum 122 as it swings back and forth between the first bumper 128 and second bumper 130 as illustrated by the dual sided arrow in FIG. 3. The bumpers (i.e., first bumper 128 and second bumper 130) are positioned opposite one another and between the pendulum 122 such that the pendulum 122 swings from the first bumper 128 to the second bumper 130 and from the second bumper 130 to the first bumper 128. In one or more embodiments, the first bumper 128 and second bumper 130 are comprised of rubber or other similar material.

In one or more embodiments, the frame 102, the first plate 114, and the second plate 116 are coupled together using screws. In one or more embodiments, the frame 102, the first plate 114, and the second plate 116 are coupled together by welding or other similar coupling methods.

Figure 4:
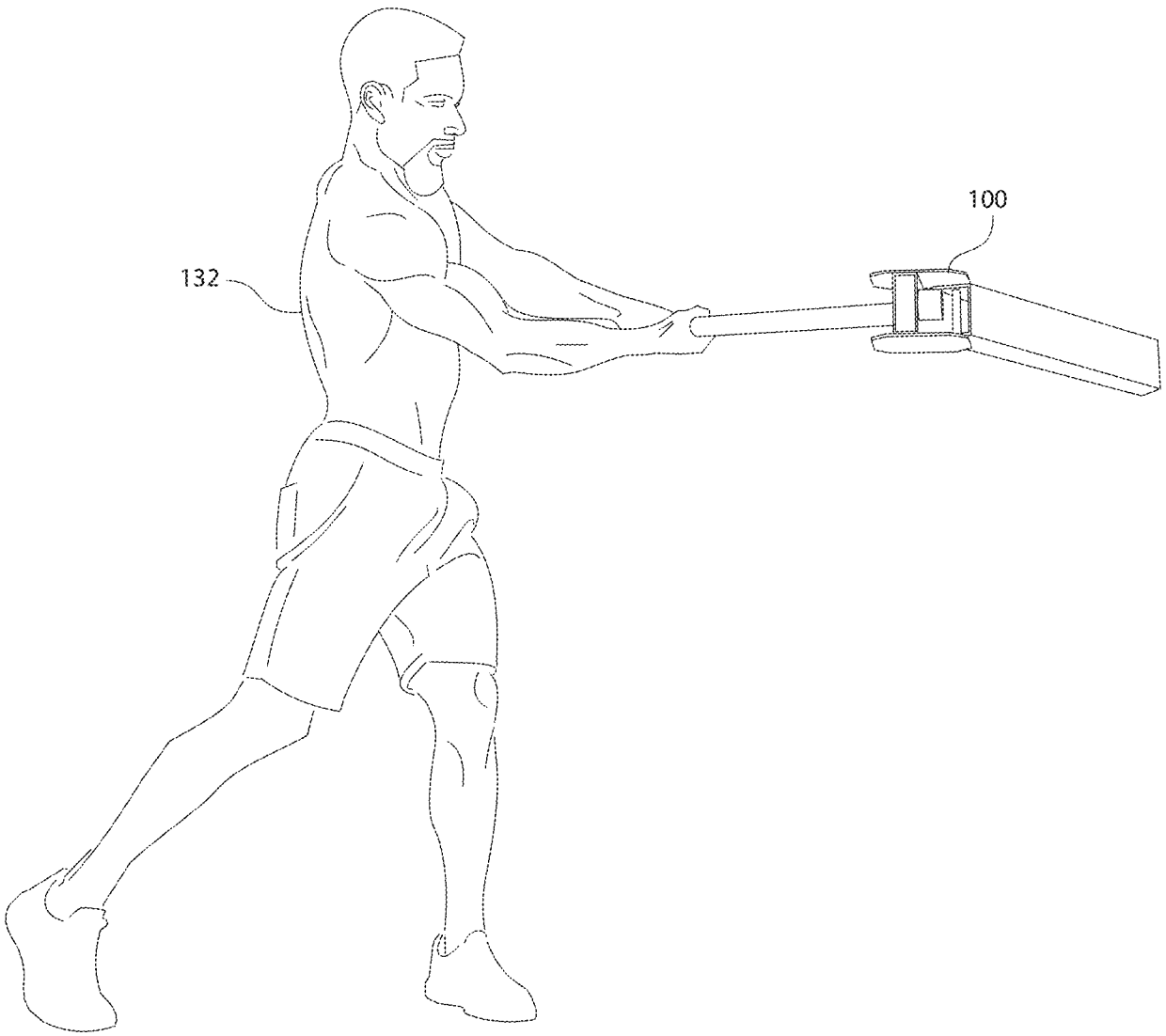
FIG. 4 is a view of an athlete swinging a core exercise apparatus.

FIG. 4 is a view of an athlete swinging a core exercise apparatus. As illustrated in FIG. 4, an individual (e.g., athlete, sports enthusiast) swings the core exercise apparatus 100 as if they were swinging a baseball bat, an axe, or a sledgehammer. As illustrated, the individual 132 will pick up the core exercise apparatus 100 and swing the core exercise apparatus 100 back and forth or up and down. The weight of the pendulum 122 creates additional momentum such that the individual's 132 core is further engaged. To control the additional momentum created by the pendulum 122 as it rotates about the rivet 124, the individual 132 must engaged its secondary muscles to stabilize the core exercise apparatus 100.

Figure 5:
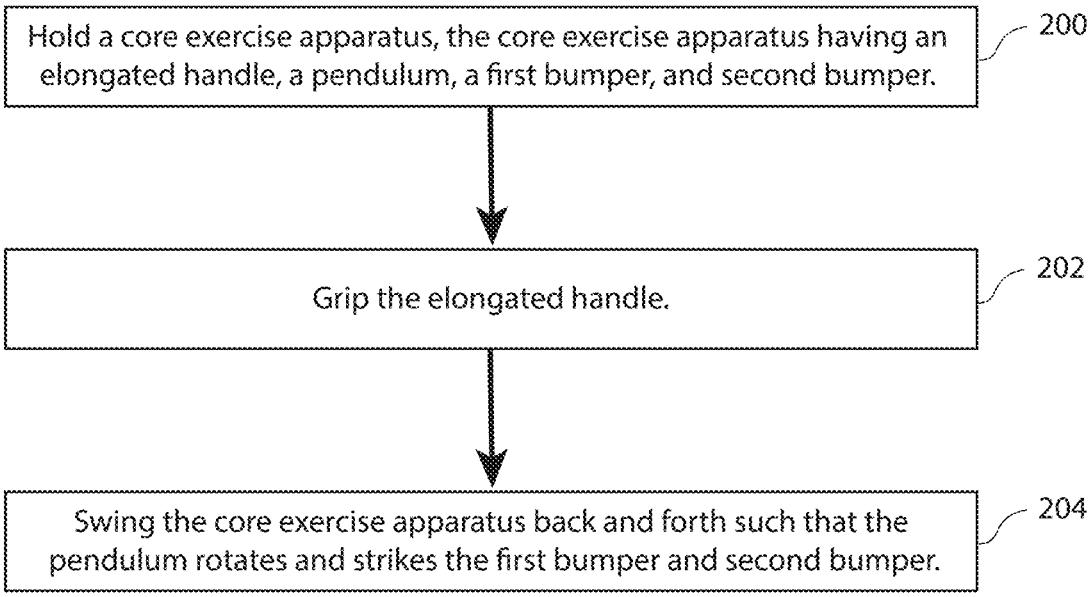
FIG. 5 is a flow chart describing how to operate a core exercise apparatus.

FIG. 5 is a flow chart describing how to operate a core exercise apparatus. In operation, the individual (such as individual 132) holds a core exercise apparatus (such as core exercise apparatus 100). The core exercise apparatus (such as core exercise apparatus 100) has an elongated handle (such as elongated handle 118), a pendulum (such as pendulum 122), a first bumper (such as first bumper 128) and a second bumper (such as second bumper 130) (block 200). The elongated handle (such as elongated handle 118) is gripped (block 202). The core exercise apparatus (such as core exercise apparatus 100) is swung back and forth such that the pendulum (such as pendulum 122) strikes the first bumper (such as first bumper 128) and second bumper (such as second bumper 130) (block 204).

In one aspect, an apparatus includes a frame. The frame has a first wall, a second wall, a frame roof, and a frame floor. A first bumper is coupled to the frame roof and a second bumper is coupled to the frame roof. A first plate is coupled to the second frame wall. An elongated handle is coupled to the frame floor. A pendulum is coupled to the first plate and second plate such that the pendulum swings from the first bumper to the second bumper and from the second bumper to the first bumper.

Implementation may include one or more of the following. The frame, the first plate, the second plate, and the pendulum may be comprised of metal. The first bumper and second bumper may be comprised of rubber. The pendulum may be interchangeable. The pendulum may include a cavity such that weighted material can be inserted into the cavity and coupled to the pendulum. The pendulum may form an elongated cube. The elongated handle may be interchangeable. A second frame may be coupled to the first frame floor. The elongated handle may include an interchangeable grip. The frame, the first plate, the second plate, and the pendulum may be coupled using screws.

In one aspect, the method includes a person holding a core exercise apparatus. The core exercise apparatus has a frame.

The frame has a first wall, a second wall, a frame roof, and a frame floor. A first bumper is coupled to the frame roof and a second bumper is coupled to the frame roof. A first plate is coupled to the second frame wall. An elongated handle is coupled to the frame floor. A pendulum is coupled to the first plate and second plate such that the pendulum swings from the first bumper to the second bumper and from the second bumper to the first bumper. The person grips the elongated handle with their hands. The person swings the core exercise apparatus back and forth such that the pendulum rotates and strikes the first bumper and second bumper.

Implementation may include one or more of the following. The frame, the first plate, the second plate, and the pendulum may be comprised of metal. The first bumper and second bumper may be comprised of rubber. The pendulum may be interchangeable. The pendulum may include a cavity such that weighted material can be inserted into the cavity and coupled to the pendulum. The pendulum may form an elongated cube. The elongated handle may be interchangeable. A second frame may be coupled to the first frame floor. The elongated handle may include an interchangeable grip. The frame, the first plate, the second plate, and the pendulum may be coupled using screws.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A core exercise apparatus comprising:

a frame, having:

a first frame wall, a second frame wall, a frame roof, and a frame floor;

a first bumper coupled to the frame roof, and a second bumper coupled to the frame roof;

a first plate coupled to the first frame wall;

a second plate coupled to the second frame wall;

an elongated handle coupled to the frame floor; and a pendulum coupled to the first plate and the second plate such that the pendulum swings from the first bumper to the second bumper and from the second bumper to the first bumper.

2. The core exercise apparatus of claim 1 wherein the frame, the first plate, the second plate, and the pendulum are comprised of metal.

3. The core exercise apparatus of claim 1 wherein the first bumper and the second bumper are comprised of rubber.

4. The core exercise apparatus of claim 1 wherein the pendulum is interchangeable.

5. The core exercise apparatus of claim 1 wherein the pendulum includes a cavity such that weighted material can be inserted into the cavity and coupled to the pendulum.

6. The core exercise apparatus of claim 1 wherein the pendulum forms an elongated cube.

7. The core exercise apparatus of claim 1 wherein the elongated handle is interchangeable.

8. The core exercise apparatus of claim 1 wherein a second frame is coupled to the frame floor.

9. The core exercise apparatus of claim 1 wherein the elongated handle includes an interchangeable grip.

10. The core exercise apparatus of claim 1 wherein the frame, the first plate, and the second plate, are coupled together using screws.

11. A method for operating a core exercise apparatus, the method comprising:

a person holding the core exercise apparatus, the core exercise apparatus having:

a frame, having:

a first frame wall, a second frame wall, a frame roof, and a frame floor;

a first bumper coupled to the frame roof, and a second bumper coupled to the frame roof;

a first plate coupled to the first frame wall;

a second plate coupled to the second frame wall;

an elongated handle coupled to the frame floor; and a pendulum coupled to the first plate and the second plate such that the pendulum swings from the first bumper to the second bumper and from the second bumper to the first bumper;

the person gripping the elongated handle with their hands; and the person swinging the core exercise apparatus back and forth such that the pendulum rotates and strikes the first bumper and the second bumper.

12. The method of claim 11 wherein the frame, the first plate, the second plate, and the pendulum are comprised of metal.

13. The method of claim 11 wherein the first bumper and the second bumper are comprised of rubber.

14. The method of claim 11 wherein the pendulum is interchangeable.

15. The method of claim 11 wherein the pendulum includes a cavity such that weighted material can be inserted into the cavity and coupled to the pendulum.

16. The method of claim 11 wherein the pendulum forms an elongated cube.

17. The method of claim 11 wherein the elongated handle is interchangeable.

18. The method of claim 11 wherein a second frame is coupled to the frame floor.

19. The method of claim 11 wherein the elongated handle includes an interchangeable grip.

20. The method of claim 11 wherein the frame, the first plate, and the second plate, are coupled together using screws.

* * * * *